US010823386B2

(12) United States Patent
Hauser et al.

(10) Patent No.: US 10,823,386 B2
(45) Date of Patent: Nov. 3, 2020

(54) ADJUSTABLE END CAP CONNECTORS FOR LIGHT EMITTING DIODE SYSTEMS

(71) Applicant: AMS Spectral UV, River Falls, WI (US)

(72) Inventors: Matthew Hauser, New Richmond, WI (US); Noel Neuman, Woodbury, MN (US)

(73) Assignee: AMS Spectral UV, River Falls, WI (US)

( * ) Notice: Subject to any disclaimer, the term of this patent is extended or adjusted under 35 U.S.C. 154(b) by 0 days.

(21) Appl. No.: 16/434,128

(22) Filed: Jun. 6, 2019

(65) Prior Publication Data

US 2019/0376678 A1 Dec. 12, 2019

Related U.S. Application Data

(60) Provisional application No. 62/681,666, filed on Jun. 6, 2018.

(51) Int. Cl.

| | |
|---|---|
| ***F21V 29/503*** | (2015.01) |
| ***F21V 23/06*** | (2006.01) |
| ***F21V 29/57*** | (2015.01) |
| *F21Y 115/10* | (2016.01) |

(52) U.S. Cl.

CPC ..... *F21V 29/503* (2015.01); *F21V 23/06* (2013.01); *F21V 29/57* (2015.01); *F21Y 2115/10* (2016.08)

(58) Field of Classification Search

CPC ..... F21V 29/503; F21V 29/57; F21V 23/06
See application file for complete search history.

(56) References Cited

U.S. PATENT DOCUMENTS

| | | | | |
|---|---|---|---|---|
| 3,967,838 | A | 7/1976 | Legris | |
| 5,467,260 | A * | 11/1995 | Aspenwall | A47F 11/10 362/374 |
| 6,155,520 | A * | 12/2000 | Giraud | B64D 29/06 16/260 |
| 2007/0246258 | A1 | 10/2007 | Magno | |
| 2011/0128680 | A1 * | 6/2011 | Martinez | H01L 33/648 361/679.01 |
| 2013/0170195 | A1 * | 7/2013 | Tang | F21S 6/003 362/220 |

FOREIGN PATENT DOCUMENTS

| | | | |
|---|---|---|---|
| JP | 2005174674 | A | 6/2005 |
| KR | 20120065552 | A | 6/2012 |

OTHER PUBLICATIONS

The International Search Report and Written Opinion rendered by the International Searching Authority for PCT/US19/35890, dated Sep. 4, 2019, 11 pages.

* cited by examiner

*Primary Examiner* — Anabel Ton
(74) *Attorney, Agent, or Firm* — Skaar Ulbrich Macari, P.A.

(57) ABSTRACT

An adjustable end cap for a high intensity LED light system includes an end cap body, a pivot base coupled to the end cap body and one or more adjustable fittings pivotally secured to the pivot base. Both coolant and electrical fittings can be provided. The end cap body defines passages therein that communicate with the coolant and electrical passages in the LED device. The coolant and electrical fittings can be pivoted transverse to the longitudinal axis of the LED device. Ninety degrees of pivot range for each fitting can be provided in one example.

20 Claims, 7 Drawing Sheets

ADJUSTABLE END CAP CONNECTORS FOR LIGHT EMITTING DIODE SYSTEMS

PRIORITY

This application claims priority under 35 U.S.C. § 119(e) to, and hereby incorporates by reference in its entirety, U.S. Provisional Application No. 62/681,666, filed Jun. 6, 2018.

FIELD

The present invention generally relates to high intensity light emitting diode devices, and more particularly to connector end caps with adjustable connectors.

BACKGROUND

High intensity light emitting diode (LED) systems are often used in curing systems to emit the radiation in the wavelengths required, e.g. ultraviolet light, to effect the curing operation. U.S. Pat. No. 8,641,236 discloses one such LED system and U.S. Patent Pub. No. 2017/0102138 A1 discloses another such system. The entirety of the disclosures of U.S. Pat. No. 8,641,236 and U.S. Patent Pub. No. 2017/0102138 A1 are incorporated herein by reference as part of this application in their entirety.

Such LED systems require connections to power and coolant supplies. A connector end cap is provided on one end of the LED device with external fittings to couple the coolant supply and the electrical power input to the device.

These high intensity LED systems are used in a variety of machines and assemblies. Thus, it is necessary for conventional LED systems to require customized fittings in order to properly connect the LED device to both power and coolant. Such customization adds cost to design and assembly of the custom fittings. Thus there is a need to provide adaptive fittings to the end cap of high intensity LED systems.

SUMMARY

The disclosure includes an adjustable end cap for a high intensity LED light system that has adjustable fittings for both power and coolant. The adjustable end cap includes an end cap body, a pivot base coupled to the end cap body and one or more adjustable fittings pivotally secured to the pivot base. Both coolant and electrical fittings can be provided. The end cap body defines passages therein that communicate with the coolant and electrical passages in the LED device. The coolant and electrical fittings can be pivoted transverse to the longitudinal axis of the LED device. Ninety degrees of pivot range for each fitting can be provided in one example.

The disclosure also includes an adjustable end cap for an LED light system. The adjustable end cap can comprise an end cap body, a pivot base coupled to the end cap body and a first adjustable fitting pivotally secured to the pivot base. The first adjustable fitting can be configured to be pivotable about an axis perpendicular to a longitudinal axis of the LED device.

A second adjustable fitting can be pivotally secured to the pivot base. The second adjustable fitting can be configured to be pivotable about the axis perpendicular to the longitudinal axis of the LED device. The second adjustable fitting can be pivotable independent of the first adjustable fitting.

The first adjustable fitting can be a coolant fitting and the second adjustable fitting can be an electrical fitting. The first adjustable fitting can comprise a banjo-type fitting. The second adjustable fitting can comprise a hollow conduit including a coupling disposed at a distal end thereof. The coupling can be rotatable with respect to the hollow conduit about a longitudinal axis of the hollow conduit.

A third adjustable fitting can be pivotally secured to the pivot base. The third adjustable fitting can be configured to be pivotable about the axis perpendicular to the longitudinal axis of the LED device. The third adjustable fitting can be pivotable independent of the first adjustable fitting and the second adjustable fitting. The third adjustable fitting can be a coolant fitting or an electrical fitting.

The second adjustable fitting is secured to the pivot base between the first adjustable fitting and the third adjustable fitting.

The adjustable fittings can have a pivot range of ninety degrees, less than ninety degrees or more than ninety degrees. The adjustable fittings can be fixed at any pivot position within a pivot range. The adjustable fittings can alternatively be fixed only at a plurality of predefined pivot positions within a pivot range. The fixing types can be varied from one fitting to another.

The LED device can define a coolant passageway through the LED device. The end cap body can define a coolant passage therein that is in communication with the first fitting and is positioned to communicate with the coolant passageway of the LED device.

The disclosure further includes a method of adjusting a coolant fitting and an electrical fitting for an LED light system. The method can comprise pivotally coupling the coolant fitting to a pivot base, pivotally coupling the electrical fitting to the pivot base, securing the pivot base to an end cap body, defining a coolant passage though the end cap body such that the coolant passage communicates with the coolant fitting and with a rear surface of the end cap body, and securing the end cap body to an LED light device such that the rear surface of the end cap body faces the LED light device and such that the coolant passage defined in the end cap body aligns with a coolant passageway defined through the LED light device.

The coolant fitting and the electrical fitting can each be independently pivoted in an axis perpendicular to a longitudinal axis of the LED light device.

The electrical conduit can comprise a hollow conduit including a coupling disposed at a distal end thereof. The method further can include pivoting the coupling with respect to the hollow conduit about a longitudinal axis of the hollow conduit.

The disclosure still further includes an LED light system. The LED light system can comprise an LED light device and an adjustable end cap coupled to the LED light device. The adjustable end cap can comprise any of the configurations or features disclosed in this application.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
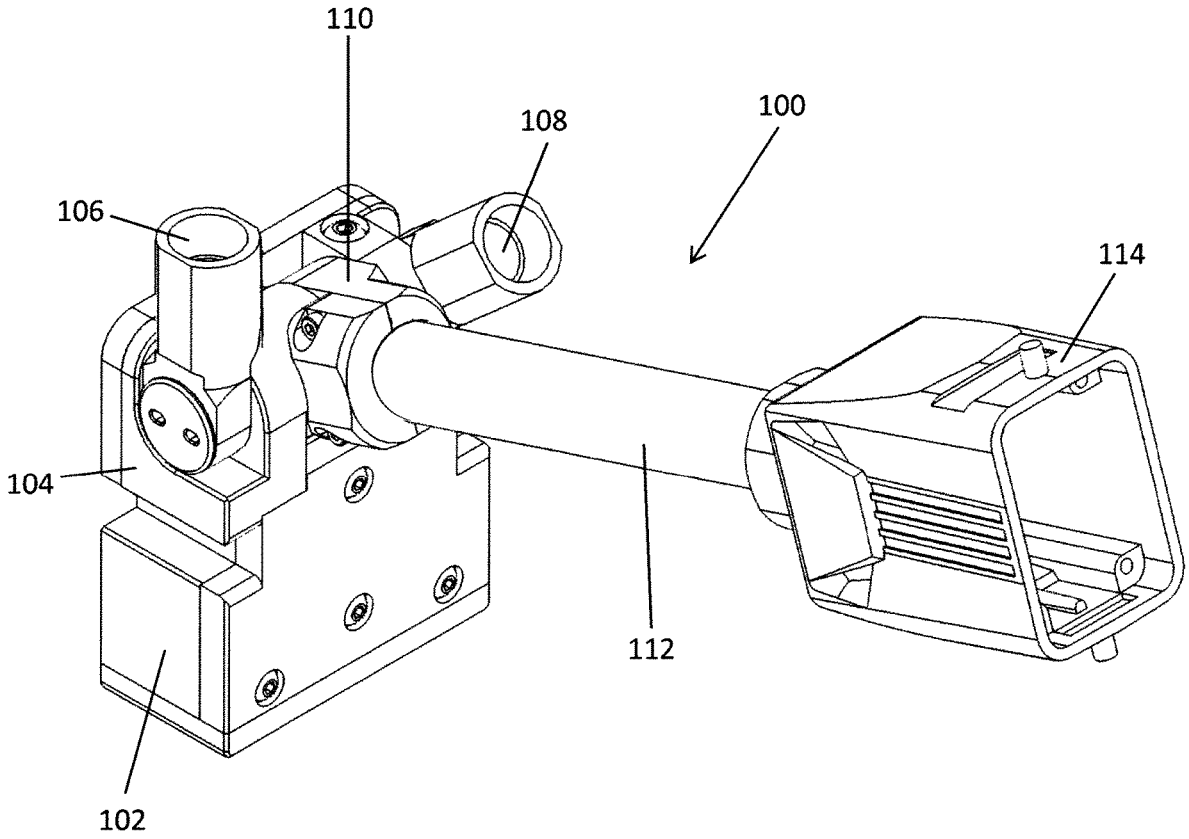
FIG. 1 is a perspective view of an adjustable end cap for an LED device according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention.

As shown in FIGS. 1-7, the adjustable end cap 100 for a high intensity LED light system generally comprises an end cap body 102, a pivot base 104 and adjustable fittings 106, 108, 110.

Figure 4:
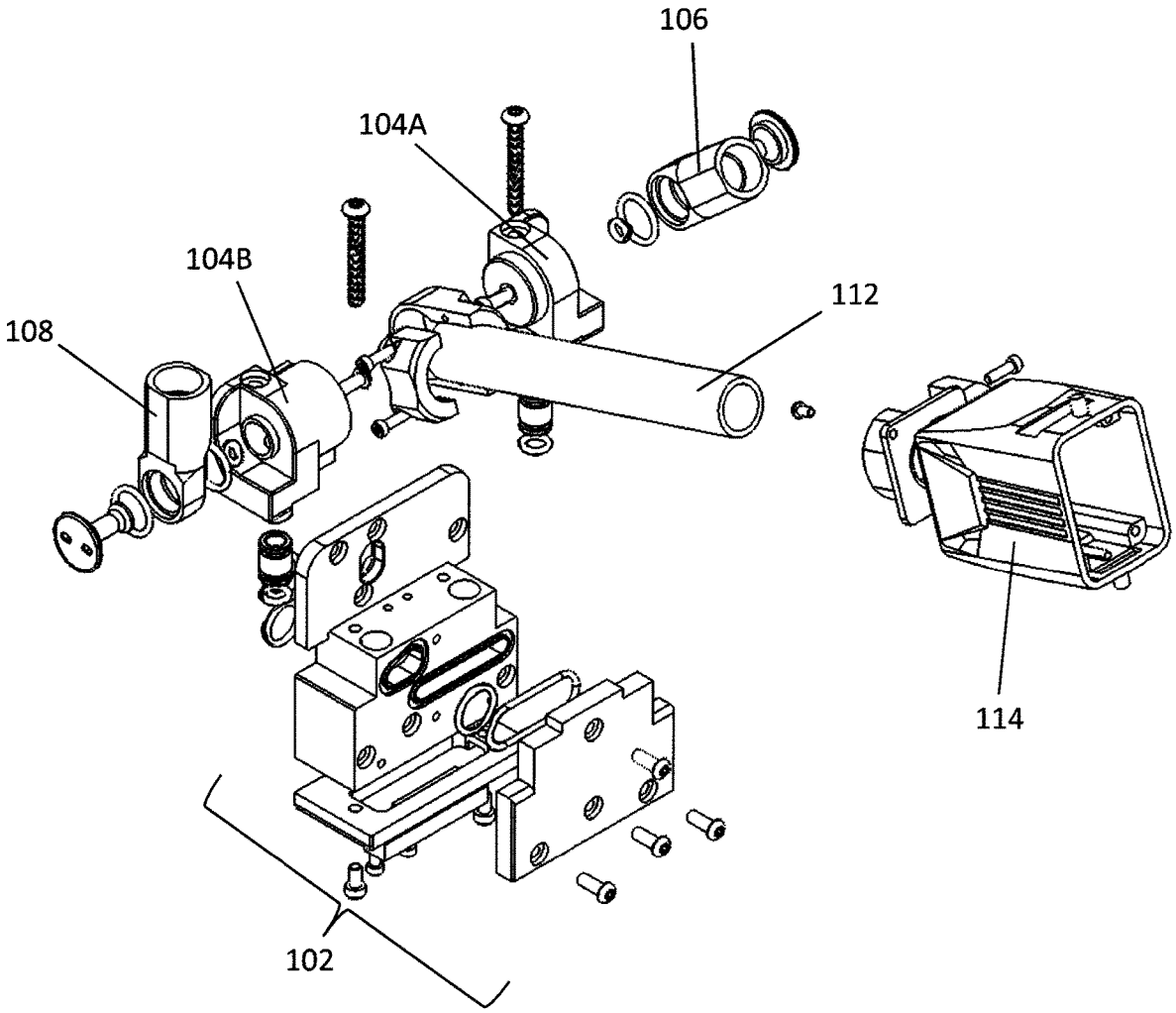
FIG. 4 is an exploded assembly perspective view of an adjustable end cap for an LED device according to certain embodiments.
Figure 5:
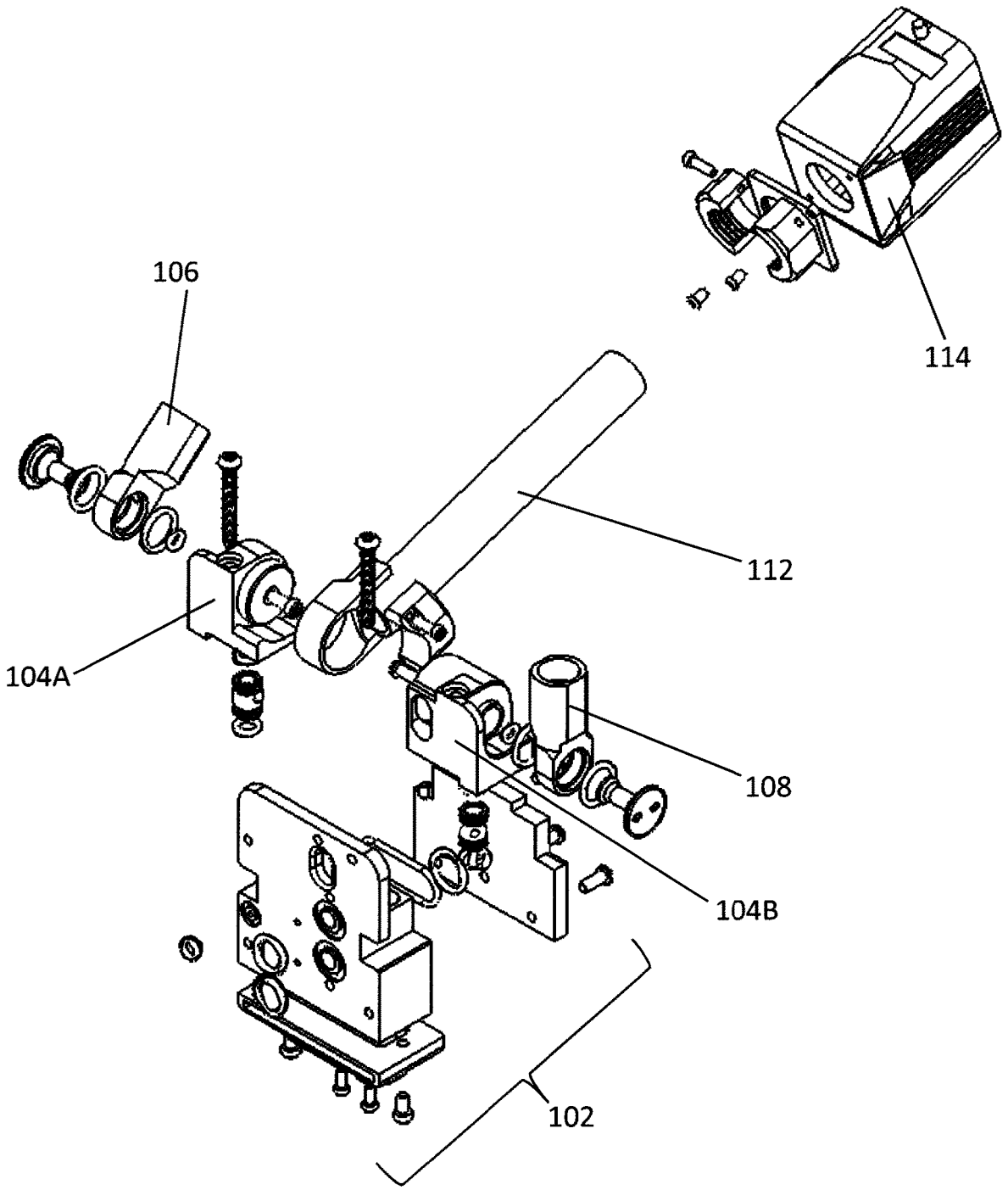
FIG. 5 is another exploded assembly perspective view of an adjustable end cap for an LED device according to certain embodiments.

The end cap body 102 can be formed from a plurality of separate parts as indicated in FIGS. 4-5 that are assembled together to form the end cap body 102. The end cap body 102 can also refer to a single part.

Figure 2:
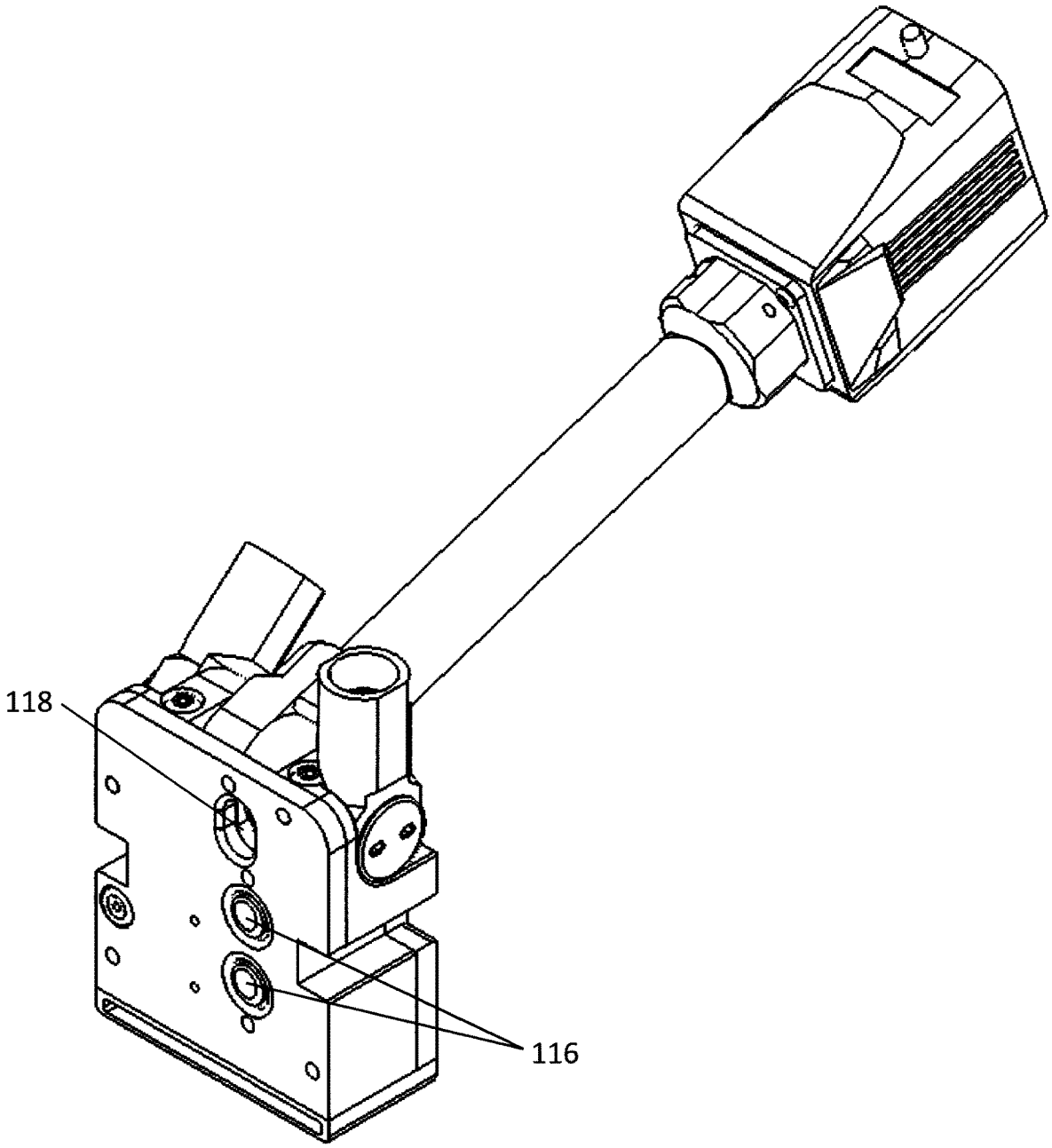
FIG. 2 is another perspective view of an adjustable end cap for an LED device according to certain embodiments.
Figure 3:
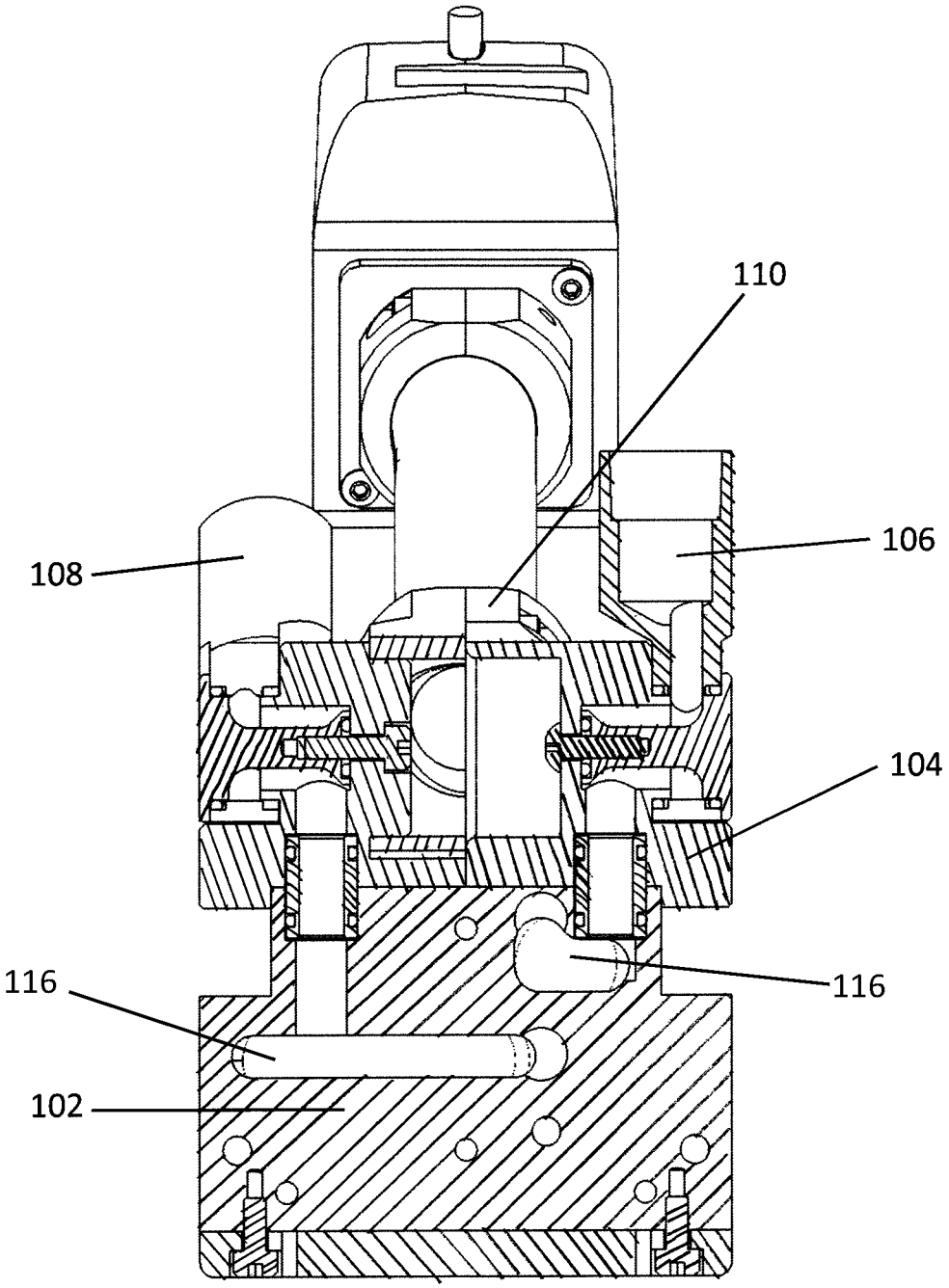
FIG. 3 is a rear cross-sectional view of an adjustable end cap for an LED device according to certain embodiments.

The end cap body 102 defines passages 116 therein that communicate with the back side of the end cap 100 (the side that abuts the LED device), as shown in FIGS. 2-3, to allow the fittings to connect to corresponding passages within the LED device. The passages 116 can be coolant conduits for passing water or other coolant types to and from the LED device. An electrical connector aperture 118 is also defined therein to allow passage of the electrical wiring or conduit.

A pivot base 104 is disposed atop the end cap body 102. The fittings 106, 108, 110 are attached to the pivot base 104. More particularly, the pivot base 104 is divided into two mirrored halves 104A and 104B (indicated in FIGS. 4-5). One of the coolant fittings 106, 108 is attached to each of the pivot base halves 104A, 104B while the electrical fitting 110 is secured laterally between each half of the pivot base.

The electrical fitting 110 is centered between the coolant fittings 106, 108. However, the fittings 106, 108, 110 can be re-arranged in other orders. Additionally, the end cap 100 can be configured for a single fitting, two fittings or more than the depicted three fittings in various additional embodiments.

A plug can be fitted into any of the fittings that will not be used.

The pivot axis for each fitting 106, 108, 110 is perpendicular to the longitudinal axis of the LED device. The pivoting range shown in the figures is approximately 90 degrees. However, the pivot axis can be greater (e.g. 120 degrees) or less than (e.g. 60 degrees) 90 degrees in various embodiments depending on the clearance provided between the fitting and the pivot base. The fittings 106, 108, 110 can be set to any position along their respective travel ranges, or they can move between a limited number of fixed defined positions. Detents or stops can be provided to the pivot base 104 to define these discreet defined positions. Each of the fittings can be locked or fixed in a desired position in their respective pivot ranges via a locking mechanism such as a locking screw tightened against the pivot base 104 or against a shaft on which the fitting pivots.

The coolant fittings 106, 108 depicted in the figures are female banjo-type fittings. Of course, male banjo fittings or any other suitable type of fitting can be provided. Adaptors for banjo fittings to other types of fittings can also be provided.

The electrical fitting 110 comprises a hollow conduit 112 with a coupling 114 disposed at the distal end thereof. The proximal end of the conduit 112 is pivotally coupled to the pivot base 104. The distal end that forms the coupling 114 can be configured as a female hood as depicted in the figures. However, any other type of suitable electrical coupling or adaptor can be provided. The electrical fitting 110 can pivot in the same manner as the coolant fittings 106, 108 described above. In addition, the coupling 114 can rotate with respect to the conduit 112 about the longitudinal axis of the conduit 112, or the conduit can rotate with respect to the pivot base along the longitudinal axis of the conduit.

The electrical coupling 114 can also be pivotally coupled directly to the pivot base 104 without the conduit 112.

In use, the adjustable connecting end plate 100 is disposed on a longitudinal end of the LED device such as that disclosed in U.S. Pat. No. 8,641,236 or U.S. Patent Pub. No. 2017/0102138 A1. The opposing end of the LED device can also receive the disclosed adjustable connecting end plate 100, or a crossover end plate can be provided. The coolant fittings 106, 108 and/or the electrical fitting 110 can be pivoted to accommodate the particular installation locations. For example, the coolant supply lines may be located such that they approach perpendicularly to the longitudinal axis of the LED device. Thus, the coolant fittings 106, 108 can be pivoted to accommodate accordingly. The electrical supply line can be accommodated similarly. The length of the conduit 112 can be changed or extensions to the conduit 112 added if necessary.

Figure 6:
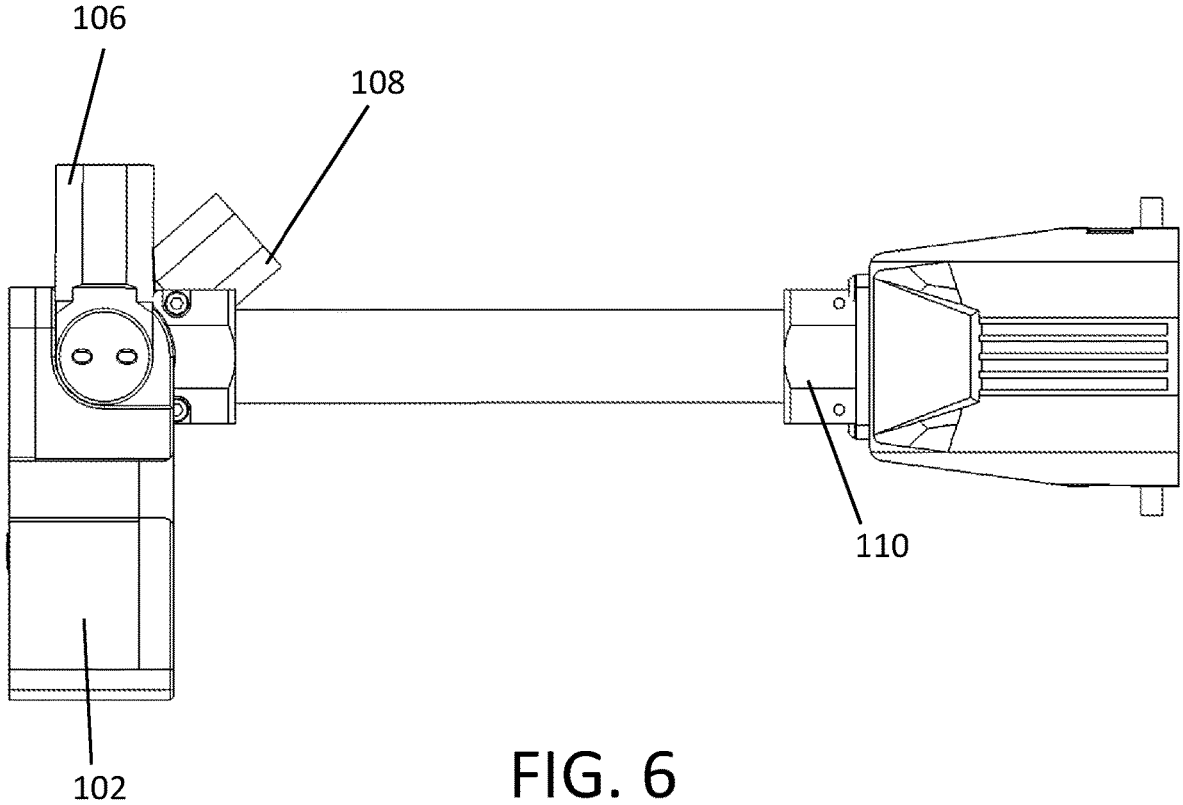
FIG. 6 is a side view of an adjustable end cap for an LED device according to certain embodiments.
Figure 7:
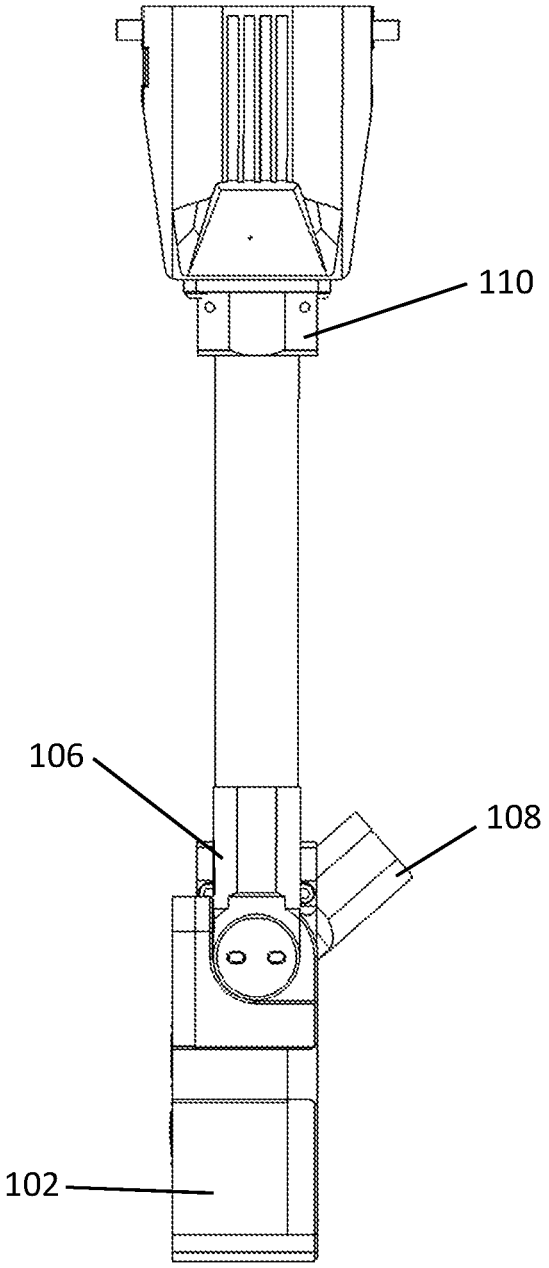
FIG. 7 is another side view of an adjustable end cap for an LED device according to certain embodiments.

FIGS. 6 and 7 show the coolant fittings 106, 108 and the electrical fitting 110 in various orientations with respect to the end cap body 102. For example, in FIG. 6, electrical fitting 110 is oriented in the horizontal plane whereas in FIG. 7, the electrical fitting 110 has been moved by ninety degrees to be oriented in the vertical plane. Meanwhile, the positions of the coolant fittings 106, 108 relative to the end cap body 102 have not moved. Each of the fittings 106, 108, 110 move independent of one another, so each can be optimally placed for their respective connections.

Thus, it can be appreciated that the need for custom connections or fittings for high powered LED systems in many situations can be eliminated or reduced according to the present invention.

The present invention may be embodied in other specific forms without departing from the spirit or essential attributes thereof, and it is, therefore, desired that the present embodiment be considered in all respects as illustrative and not restrictive. Those skilled in the art may recognize other equivalents to the specific embodiment described herein which equivalents are intended to be encompassed by the claims attached hereto.

What is claimed is:

1. An adjustable end cap for an LED light system, the LED light system comprising an elongated body defining a longitudinal axis spanning between opposing longitudinal ends of the elongated body, the adjustable end cap comprising:

an end cap body;

a pivot base coupled to the end cap body; and a first adjustable fitting pivotally secured to the pivot base, wherein the first adjustable fitting is configured to be pivotable about an axis perpendicular to the longitudinal axis of the LED light system.

2. The adjustable end cap of claim 1, further comprising a second adjustable fitting pivotally secured to the pivot base, wherein the second adjustable fitting is configured to be pivotable about the axis perpendicular to the longitudinal axis of the light system, and wherein the second adjustable fitting is pivotable independent of the first adjustable fitting.

3. The adjustable end cap of claim 2, wherein the first adjustable fitting is a coolant fitting and the second adjustable fitting is an electrical fitting.

4. The adjustable end cap of claim 2, wherein the first adjustable fitting comprises a banjo-type fitting, and the second adjustable fitting comprises a hollow conduit including a coupling disposed at a distal end thereof.

5. The adjustable end cap of claim 4, wherein the coupling is rotatable with respect to the hollow conduit about a longitudinal axis of the hollow conduit.

6. The adjustable end cap of claim 2, further comprising a third adjustable fitting pivotally secured to the pivot base, wherein the third adjustable fitting is configured to be pivotable about the axis perpendicular to the longitudinal axis of the light system, and wherein the third adjustable fitting is pivotable independent of the first adjustable fitting and the second adjustable fitting.

7. The adjustable end cap of claim 6, wherein the second adjustable fitting is secured to the pivot base between the first adjustable fitting and the third adjustable fitting.

8. The adjustable end cap of claim 1, wherein the first adjustable fitting has a pivot range of ninety degrees.

9. The adjustable end cap of claim 1, wherein the first adjustable fitting can be fixed at any pivot position within a pivot range.

10. The adjustable end cap of claim 1, wherein the first adjustable fitting can be fixed only at a plurality of predefined pivot positions within a pivot range.

11. The adjustable end cap of claim 1, wherein the LED light system defines a coolant passageway through the LED light system, the end cap body defines a coolant passage therein that is in communication with the first adjustable fitting and is positioned to communicate with the coolant passageway of the LED light system.

12. A method of adjusting a coolant fitting and an electrical fitting for an LED light system, the method comprising:

pivotally coupling the coolant fitting to a pivot base;

pivotally coupling the electrical fitting to the pivot base;

securing the pivot base to an end cap body;

defining a coolant passage through the end cap body such that the coolant passage communicates with the coolant fitting and with a rear surface of the end cap body; and securing the end cap body to an LED light device such that the rear surface of the end cap body faces the LED light device and such that the coolant passage defined in the end cap body aligns with a coolant passageway defined through the LED light device.

13. The method of claim 12, further comprising pivoting the coolant fitting in an axis perpendicular to a longitudinal axis of the LED light device.

14. The method of claim 12, further comprising pivoting the electrical fitting in an axis perpendicular to a longitudinal axis of the LED light device.

15. The method of claim 12, wherein the electrical conduit comprises a hollow conduit including a coupling disposed at a distal end thereof, the method further comprising pivoting the coupling with respect to the hollow conduit about a longitudinal axis of the hollow conduit.

16. An LED light system, comprising an LED device and an adjustable end cap coupled to the LED device, the adjustable end cap comprising:

an end cap body;

a pivot base coupled to the end cap body; and a first adjustable fitting pivotally secured to the pivot base, wherein the first adjustable fitting is configured to be pivotable about an axis perpendicular to a longitudinal axis of the LED device, wherein the end cap body defines a coolant passage therein that is in communication with the first adjustable fitting and is positioned to communicate with a coolant passageway extending through the LED device.

17. The adjustable end cap of claim 16, further comprising a second adjustable fitting pivotally secured to the pivot base, wherein the second adjustable fitting is configured to be pivotable about the axis perpendicular to the longitudinal axis of the LED device, and wherein the second adjustable fitting is pivotable independent of the first adjustable fitting.

18. The adjustable end cap of claim 17, wherein the first adjustable fitting comprises a banjo-type fitting, and the second adjustable fitting comprises a hollow conduit including a coupling disposed at a distal end thereof.

19. The adjustable end cap of claim 18, wherein the coupling is rotatable with respect to the hollow conduit about a longitudinal axis of the hollow conduit.

20. The adjustable end cap of claim 16, wherein the first adjustable fitting can be fixed only at a plurality of predefined pivot positions.

* * * * *